United States Patent [19]

Zettner

[11] Patent Number: 4,590,761

[45] Date of Patent: May 27, 1986

[54] ROTARY COMBUSTION CHAMBER REACTION ENGINE

[76] Inventor: Michael Zettner, Erlenstrasse 1, 8510, Fürth, Bavaria, Fed. Rep. of Germany

[21] Appl. No.: 643,326

[22] Filed: Aug. 22, 1984

Related U.S. Application Data

[63] Continuation-in-part of Ser. No. 442,201, Nov. 16, 1982, abandoned.

[30] Foreign Application Priority Data

Nov. 19, 1981 [DE] Fed. Rep. of Germany ..... 3145783

[51] Int. Cl.[4] ..... F02C 5/04

[52] U.S. Cl. ..... 60/39.34; 123/248

[58] Field of Search ..... 60/39.34, 39.35; 123/235, 237, 244, 246, 248; 418/60, 186, 246

[56] References Cited

U.S. PATENT DOCUMENTS

| | | | |
|---|---|---|---|
| 1,239,853 | 9/1917 | Walter | 123/248 X |
| 1,478,378 | 12/1923 | Brown | 123/248 |
| 3,712,273 | 1/1973 | Thomas | 123/248 |
| 3,716,989 | 2/1973 | Moreira | 60/39.34 |
| 3,960,117 | 6/1976 | Kammerer | 123/248 X |
| 4,075,981 | 2/1978 | Durst | 418/246 X |
| 4,229,938 | 10/1980 | Gallagher | 60/39.34 |

FOREIGN PATENT DOCUMENTS

| | | | |
|---|---|---|---|
| 283368 | 4/1915 | Fed. Rep. of Germany | 123/248 |
| 2429553 | 1/1976 | Fed. Rep. of Germany | 123/248 |

*Primary Examiner*—Michael Koczo

*Attorney, Agent, or Firm*—Sughrue, Mion, Zinn, Macpeak & Seas

[57] ABSTRACT

A rotary engine comprises a circular rotor surrounded by an annular stator. The rotor is provided around its outer circumference with spaced combustion chambers and with recesses therebetween. Each recess serves as an expansion chamber for a jet of gas produced by combustion in an associated combustion chamber. Each recess is also provided, remote from the associated combustion chamber, with a cam. The stator at its inner circumference has retractible reaction members which are movable into the recesses to be acted on by the gas jet so as to create forces acting in opposite sense on the rotor and stator and thus cause the rotor to rotate. The reaction members have deflector surfaces arranged to deflect the gas jet in such a manner that the members are drawn into the recesses, the members being engaged by the cams during the rotor rotation and moved back into the stator.

15 Claims, 8 Drawing Figures

ROTARY COMBUSTION CHAMBER REACTION ENGINE

BACKGROUND OF THE INVENTION

This application is a continuation-in-part of application Ser. No. 442,201 of 16th Nov. 1982, now abandoned.

The present invention relates to an internal combustion engine, and has particular reference to a rotary engine, especially a rotary engine of the type in which the stator surrounds the rotor.

Numerous designs of rotary piston engines have been developed but many have not succeeded in overcoming teething difficulties and few have gained ground against conventional reciprocating engines. The rotary piston engine known as the Wankel engine has been developed furthest in this field, but has not managed to supplant the reciprocating engine due to problems with, for example, sealing materials. Nevertheless, the basic idea of the rotary engine, i.e. of departing from the reciprocating principle and translating the expansion forces of combustion gases directly into a rotary movement, retains its validity. This concept also has expression in the turbine. However, the high rotational speed of the turbine limits its application in many cases, as this high rotational speed restricts its performance at lower levels. Conversely, the performance of the piston engine is restricted at upper levels, due to space, weight and inertia considerations.

A further problem, namely that of detonation, has recently arisen in connection with attempts to adapt conventional piston engines to use hydrogen as fuel. A mixture of air and hydrogen is susceptible to self-ignition. Thus, in the compression phase of a piston engine premature ignition can occur and lead to a reduced power output or even engine damage. Although this danger is lessened if liquid hydrogen is used, it is still not eliminated, as a part of the liquid hydrogen mixture can convert into a gaseous mixture of hydrogen and air. Such a conversion is promoted by the high operating temperature. Ancillary problems arising in this case are fuel storage and fuel supply, as temperature resistant materials and processes are necessary. The substantial costs involved in liquefaction of hydrogen place the economics of such an engine in question.

In German (Federal Republic) published specification (Offenlegungsschrift) No. 24 29 553 there is disclosed a rotary piston engine with a rotor of circular cross-section and a circular stator surrounding the rotor, wherein the flap is pivotably mounted at the inside of the stator and can be tilted back into the stator. This engine, which operates on the expansion principle, entails the disadvantage that the rotor is sealed relative to the stator by a sealing strip which is subject to a high rate of wear. Moreover, the engine has a dead zone resulting from correspondence of a gas exit opening in the rotor with an outlet opening in the stator in a certain rotational relationship. Finally, this engine also possesses the basic disadvantage of all known rotary piston engines of having little or no torque in the lower speed range.

In a further German patent specification, No. 28 33 68 of Schroeder, there are described two versions (FIGS. 1 to 8 and FIGS. 9 to 11) of a compound motor, each version of which includes a rotary engine. The engine consists of an internal rotor and a concentric external stator, the latter having reciprocating radial slides which are displaceable out of the stator to project into recesses in the rotor and which are subsequently displaceable back into the stator. In the case of the version of FIGS. 1 to 8, combustion takes place within the slides themselves and drives the slides towards the rotor, the consequence of which is that a complicated system of compressed air damping of the slides is required as well as a spring-loaded lever and cam system to prevent excessive frictional drag on the rotor. The need for a substantial number of moving parts, including valves for both fuel and compressed air induction, a precisely synchronised co-ordination of the different systems influencing the slide movement, and extensive sealing arrangements are all disadvantages of this version of the engine, in which both the slides and the combustion chambers are located in the stator so that the rotor has no function other than to serve as the driven member.

In the case of the version of FIGS. 9 to 11, combustion takes place in combustion chambers in the rotor itself and the expanding gas impinges against flat radial slides serving as reaction members. As is apparent from the drawings, each of the slides is carried at its radially outer end by a crossbar held to two radially displaceable posts biassed by coil tension springs. The tension springs act to draw the slides against the outer circumference of the rotor, which is formed as a cam track to outwardly displace the slides against the force of the springs. Since the springs are relied on to ensure engagement of the slides with the rotor and since this engagement must also provide a gas-tight seal between slides and rotor, the spring-loaded slides exert an appreciable braking moment on the rotor. Moreover, a substantial spring force must be maintained in order to overcome spring inertia at higher rotor speeds and floating of the slides clear of the rotor. Such a spring system is not compatible with the higher rotational speeds demanded of present-day rotary engines.

Instanced as further examples of prior art rotary engines employing spring-loaded flat slides are the engines of U.S. Pat. Nos. 3,712,273 (Thomas) and 3,960,117 (Kammerer) in which stator-mounted flat slides are biassed by coil compression springs against the periphery of an internal rotor. As a departure from the use of coil springs, U.S. Pat. No. 4,075,981 (Durst) shows bowed leaf springs acting on the outer ends of flat radial slides or vanes to maintain constant engagement thereof with the rotor.

An alternative approach to displacement of such slides in rotary engines is that of purely mechanical control by directly coupled or remote cam systems. In U.S. Pat. No. 1,478,378 (Brown), block-like slides are raised out of the path of rotor lobes by cam tracks at the lobes. Each slide is articulated to a rocker having a cam follower heel which is moved into the downstream path of the cam track when the slide is raised. Continuing movement of the rotor thus brings the cam track into contact with the cam follower heel of the rocker and pivots the slide into a recess in the rotor behind the lobe. Combustion in this case takes place in the slide itself, the rotor having no function other than that of a driven member, as in the case of the first version of the Schroeder engine. The Brown system also entails a considerable number of moving parts and is prone to wear, compensation for which is, however, precluded by the purely mechanical nature of the system, while the extended phase of interengagement of cam track and cam follower imposes increased frictional drag on the rotor.

Even greater mechanical constraint is embodied in the system of U.S. Pat. No. 1,239,853 (Walter), in which a reciprocating slide or abutment is controlled by a complicated system of a trunnion, an extended external connecting rod pair, a crank with associated pinion, and a cam-driven segment gear driving the pinion under the control of the rotor, such a system imposing a substantial and eccentric load on the rotor. In such systems where wear can arise and cannot be compensated for by, for example, springs, the critical (for rotary engines) sealing efficiency is generally low.

It is accordingly one object of the present invention to provide an internal combustion engine which avoids some or all of the recited disadvantages of the known engines, especially an engine operating on the principle of a rotary engine. More particularly, the present invention seeks to reduce the complexity of movement control systems in such an engine, with concomitant reduction in both wear and inertial or frictional loading of the engine rotor whereby increased engine life and higher rotational speeds may be achieved.

A further and related object of the invention is to provide an engine capable of operating with different types of fuels, particularly gaseous hydrogen, in a problem-free manner.

Yet another object of the invention is to provide an engine capable of achieving a low proportion of noxious constituents in its exhaust gas in accordance with current environmental considerations.

Other objects and advantages of the invention will be apparent from the following description.

SUMMARY OF THE INVENTION

According to the present invention there is provided an internal combustion engine comprising a circular inner element, preferably serving as a rotor, and a concentric outer element, preferably serving as a stator, the two elements being rotatable relative to each other about the axis of concentricity. A first one of the two elements has, around its circumference facing the second element, equidistantly spaced recesses serving as expansion chambers, with a combustion chamber being disposed at one end of each recess. Combustion gas from each combustion chamber is constrained, as by a nozzle, to emerge into the associated recess, i.e. expansion chamber, as a jet directed towards the end of the recess remote from the combustion chamber. The second one of the two elements is provided around its circumference facing the first element with equidistantly spaced reciprocating reaction members each movable into and out of the recesses, such that when projecting into the recesses the reaction members serve as barriers to the gas jets and mutually opposite forces act on the two elements to effect their relative rotation. Whereas movement of the reaction members out of the recesses is effected by cams associated with the first one of the two elements, movement into the recesses is effected at least partly by the gas jets themselves, for which purpose the reaction members have shaped deflection surfaces able to deflect the gas jets in such a manner as to translate a component of the jet energy into the desired directional movement of the reaction members.

The provision of such deflection surfaces to effect particular directional deflection of impinging gas streams provides a means of moving the reaction members into the recesses in a notably simple manner, the gas itself being employed for a task formerly the function of spring or cam systems. To facilitate starting, resilient biassing of the reaction members into the recesses can be provided, such biassing being achieved through the use of, for example, relatively light helper springs. At normal engine speeds the gas jet deflection at the reaction members is sufficient to ensure movement of the members into the recesses. Such a system dispenses with the need for complex control and synchronizing systems with a high number of moving parts and associated wear and inertia problems. Frictional drag on the rotor is substantially reduced by the absence of heavy spring loading of the reaction members and good sealing efficiency obtained.

Moreover, an engine with the described features has the advantage that it can be operated with simple hydrogen gas oxidized with oxygen from the atmosphere. Premature ignition can be avoided by bringing the hydrogen and air together in the combustion chambers only immediately before ignition. A compression phase is not present. Subsequent detonation of unburnt gas residues has no disadvantageous effect on the engine or its running, but is translated into additional driving energy.

BRIEF DESCRIPTION OF THE DRAWINGS

An embodiment of the present invention will now be more particularly described, by way of example, with reference to the accompanying drawings, in which.

DESCRIPTION OF THE PREFERRED EMBODIMENT

Figure 1:
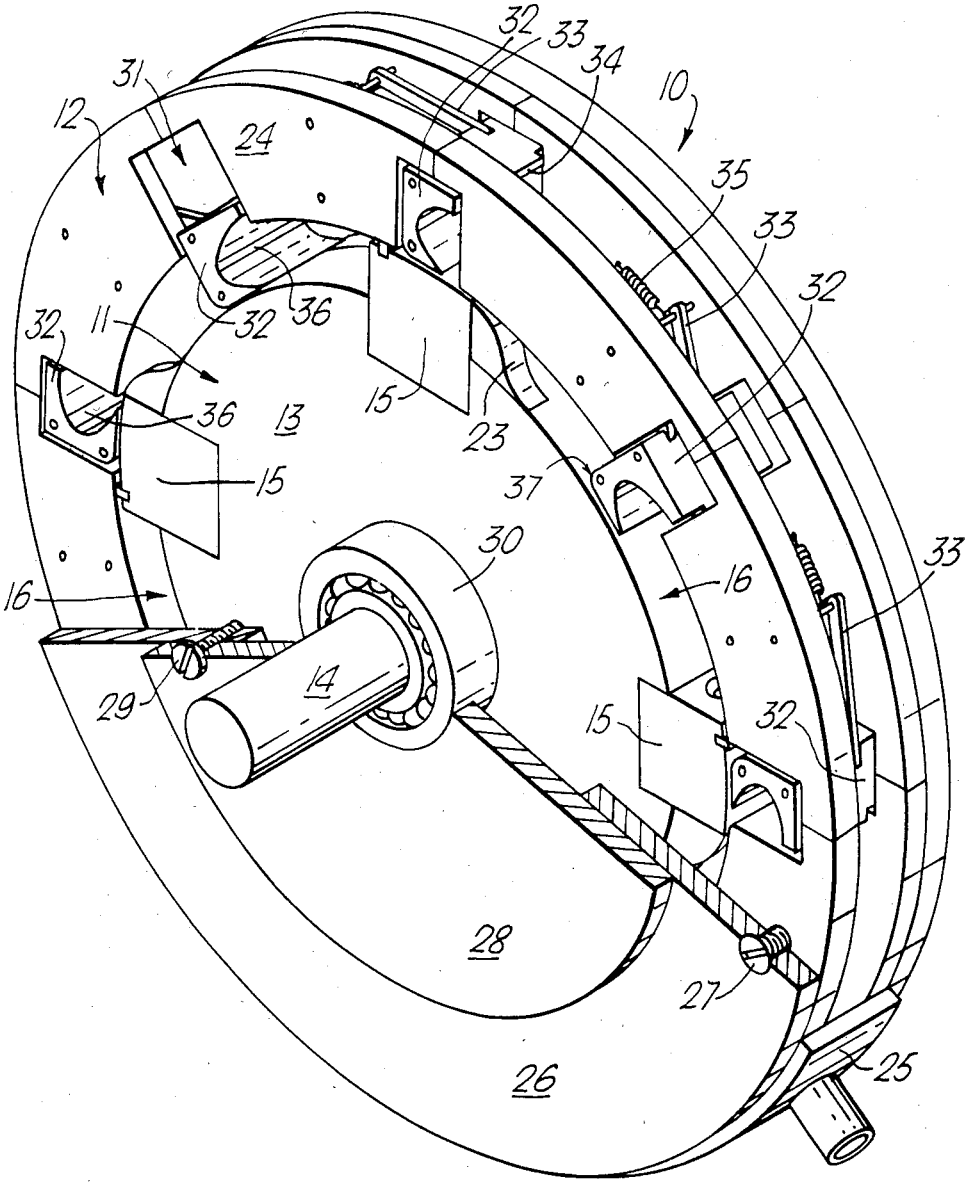
FIG. 1 is a schematic partly broken away perspective view of a rotary engine embodying the invention, wherein part of an axial end cover and part of a circumferential cover of the engine are removed to expose the rotor and surrounding stator.

Referring now to the illustrated embodiment, there is shown a rotary internal combustion engine 10 which comprises as basic elements a circular inner element serving as a rotor 11 and a concentric annular outer element serving as a stator 12. This is the preferred relationship of rotor and stator, but it will be appreciated that the functions of the elements can be reversed, i.e. the inner element can be the stator and the outer element the rotor.

The rotor 11 consists of a circular body 13 fixedly mounted on an axle 14, from which rotational drive provided by the engine is taken by any desired means. The rotor body 13 is provided at its periphery with four equidistantly spaced insert blocks 15 (only three of which are visible in FIGS. 1 and 2) inserted into the body 13 to radially project therefrom, the radially outermost extremities of the insert blocks 15 being curved to lie on a circular line which thus represents the outermost circumference of the rotor proper. The rotor 11 is thereby provided at its outer circumference with four equidistantly spaced recesses 16 which are represented by the spaces between the projecting parts of the insert blocks 15 and which serve as combustion gas expansion chambers, as will be later explained in more detail in connection with FIGS. 3*a* to 3*f*.

Whilst construction of the rotor 11 from a circular body 13 with inserted insert blocks 15 constitutes a particularly simple form of manufacture, other constructional methods consistent with mass-production techniques are equally feasible.

Figure 2:
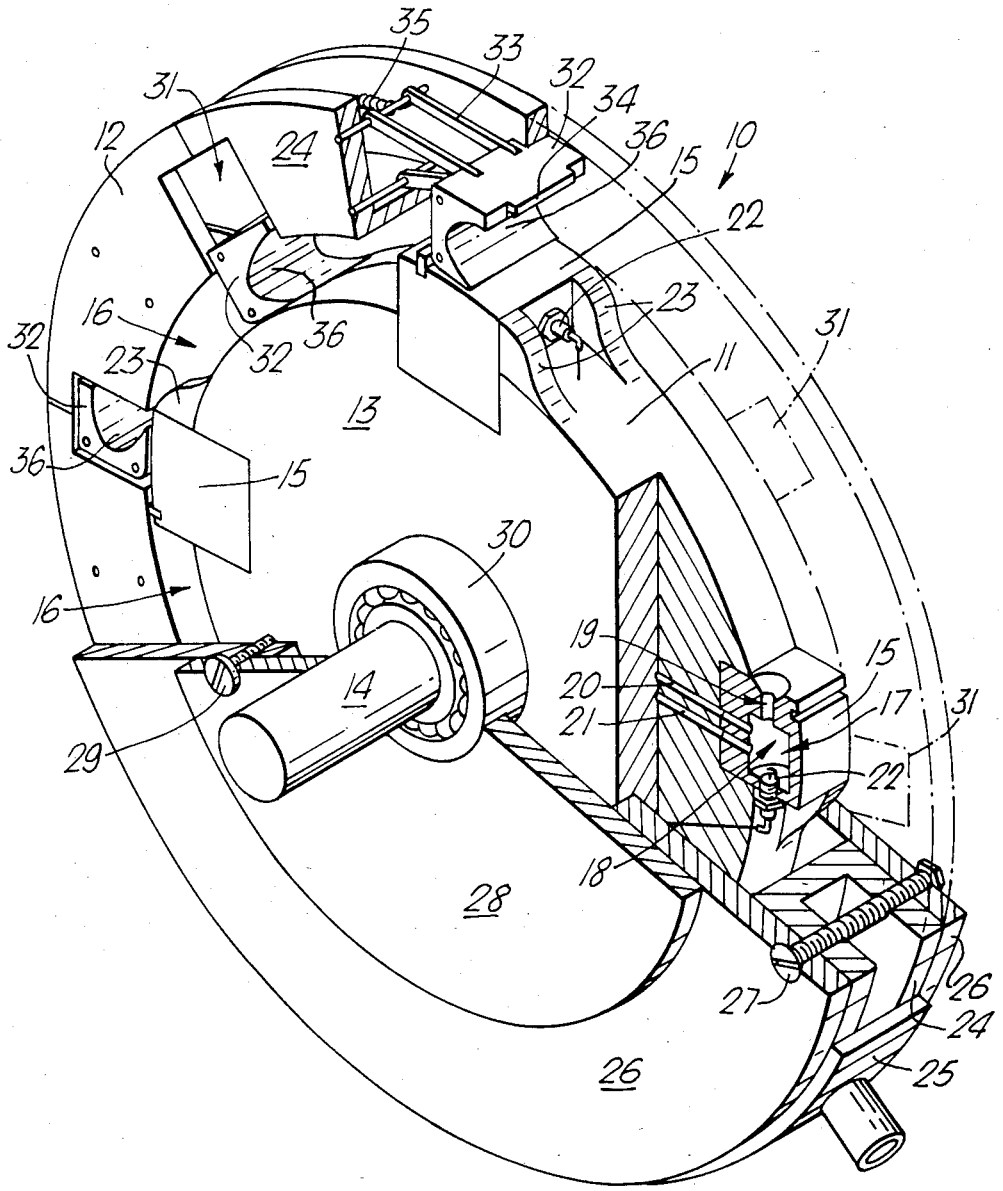
FIG. 2 is a view similar to FIG. 1 but additionally with part of the rotor and part of stator broken away to reveal details of the construction of a combustion chamber and details of a reaction member acted on by gas from such chamber.

As shown in FIG. 2 in particular, each of the insert blocks 15 internally defines a combustion chamber 17, which consists of a cylindrical space 18 for reception of fuel constituents and a smaller diameter cylindrical outlet nozzle 19 which connects the space 18 to an adjacent one of the recesses 16 and which has a flared outlet end. The nozzle 19 is thus arranged to form combustion gas, which is exiting from the space 18, into a jet and to direct the jet generally towards the end of the respective recess 16 remote from the combustion chamber 17.

The fuel constituents are supplied to each space 18 by way of an individual pair of ducts 20 and 21 in the form of bores passing through the associated insert block 15 and registering with radial bores in the rotor body 13, the ducts 20 serving for the supply of one fuel constituent, for example hydrogen, and the ducts 21 for the supply of another fuel constituent, for example air. The two fuel constituents, which are brought together under certain pressure conditions in each combustion chamber 17, are ignited by an ignition probe 22 which is mounted in each insert block 15 to project into the associated space 18. The quantities of the individual constituents and their pressures can be precisely determined and regulated by, for example, compressors driven from the axle 14. By means of the ignition probes 22, it is possible to set the ignition, i.e. ignition temperature and ignition instant, in a manner appropriate to the particular fuel constituents. The usual stoichiometric ratios can be observed for the employed fuel constituents as well as the effects on the material of the insert blocks 15. Compression of the fuel constituents does not take place in the combustion chambers 17 and premature or late ignition no longer occurs. The problem of self-ignition of certain gases, for example hydrogen, does not arise. In any case, premature or late ignition would be of little consequence to the function of the engine 10 by contrast to a reciprocating piston engine, in which the instant of ignition must be closely related to the highest point of movement of the piston (top dead centre) in order that the transmitted movement of the piston is in the correct sense of rotation to the engine crankshaft.

The separate feed of the fuel constituents to the two groups of ducts 20 and 21 can be conveniently effected by way of suitable feed bores (not illustrated) extending axially in the axle 14. Similarly, current supply to each of the ignition probes can be by way of insulated wires extending through bores in the axle 14 and in the rotor body 13.

Arranged at the end of each recess 16 remote from the associated combustion chamber nozzle 19 is a cam 23 in the form of a pair of spaced cam elements each defining a cam track having a gradual transition from the base of the associated recess and a gradual transition to the radially outermost surface of an adjoining one of the insert blocks 15. The pairs of cam elements can be formed integrally with or secured to the respectively adjoining insert blocks. The function of the cams 23 will be explained in more detail later.

The stator 12 consists of a U-section annular body 24 composed of conjoined individual arcuate segments and closed at its outer circumference by a circumferential cover 25. The stator 12 is covered at each of its axial ends, and thus the recesses 16 at their sides, by a radially outer cover plate 26 secured to the stator body 24 by bolts 27 (only one of which is shown in FIGS. 1 and 2) and by a radially inner cover plate 28 secured to the outer plate 26 by bolts 29 (only one of which is shown in FIGS. 1 and 2) and to the outer race of a ball bearing 30, the inner race of which is fixed on the axle 14. The annular body 24, the circumferential cover 25 and the annular cover plates 26 and 28 together with the outer race of the bearing 30 thus form a stator assembly mountable in a fixed location, while the rotor 11 together with the inner race of the bearing 30 and the axle 14 are free to rotate relative to such stator assembly.

The stator body 24 is provided around its inner circumference with eight equidistantly spaced housings 31 (only five of which are visible in FIG. 1) each receiving as a relatively close fit therein a respective reaction member 32 constructed of a light metal. Each reaction member 32 is connected to the stator body 24 by a parallelogram-type guide linkage 33 guiding the reaction member for reciprocating parallel displacement generally radially of the rotor and the stator. As can be appreciated from FIG. 2 in particular, each reaction member 32 is displaceable between a retracted position, in which it is fully received in the associated housing 31, and an extended position in which it projects into any one of the rotor recesses 16 that, depending on the instantaneous rotational relationship of the rotor and stator, lies radially inward of the housing 31. It will be appreciated that the linkage 33 and housings 31 are shown only schematically; in practice, of course, each member is guided by the associated linkage along an arcuate path and the housings 31 are appropriately adapted to this path.

Figure 3A:
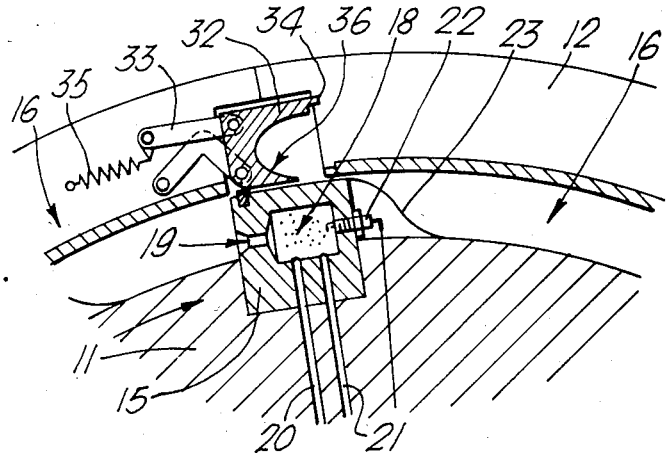
FIGS. 3*a* to 3*f* are sectional views, in highly diagrammatic representation, of part of the rotor and stator of the engine of FIGS. 1 and 2 illustrating a combustion phase of such engine.
Figure 3B:
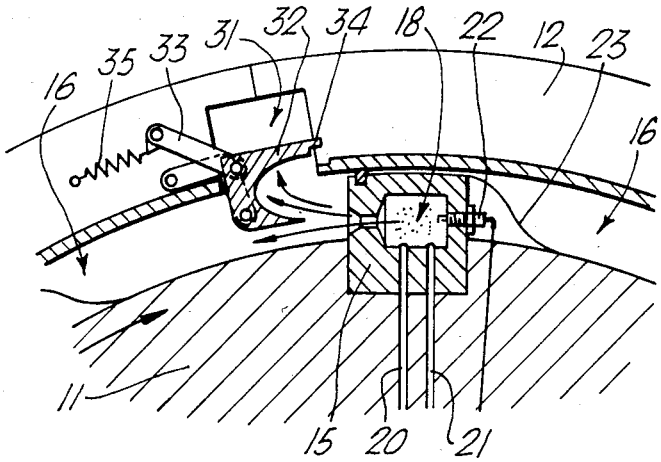
Figure 3C:
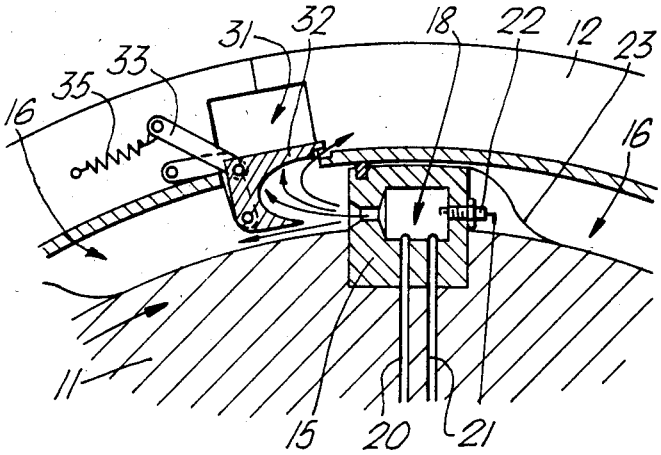
Figure 3D:
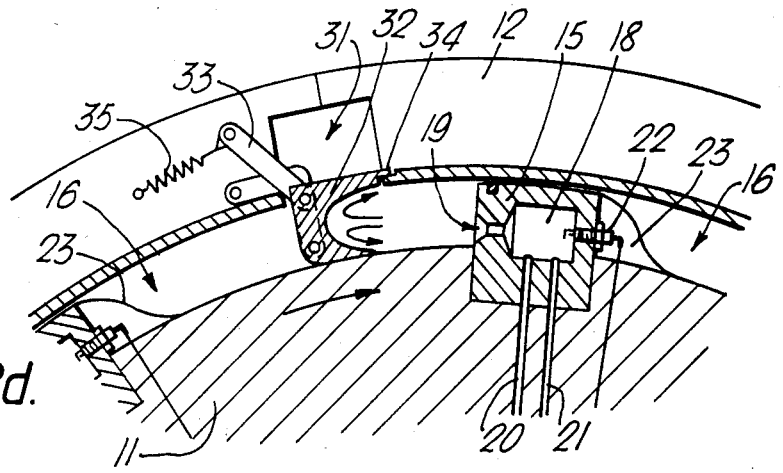
Figure 3E:
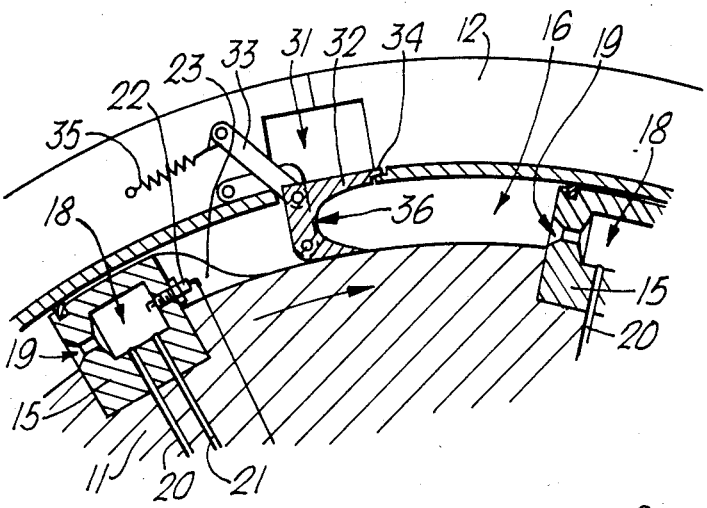

The radially inward movement of each reaction member 32 into the recesses 16 can be limited by suitable abutment means, for example an abutment lug 34 arranged on each reaction member to contact the base of the U-section stator body 24 (cf. FIGS. 3*d* and 3*e*). Another such abutment can be provided on each linkage 33 so as to abut the associated reaction member 32 and preclude continuing radially inward displacement thereof. By means of such abutments, the radially inward movement of the reaction members 32 can be limited in such a manner that in their extended positions the reaction members are spaced from the bases of the stator recesses 16 by a small amount, for example five micromillimeters.

With appropriate design of the reaction members 32 and the housings 31, the members 31 can instead be connected to the stator body 24 by pivot levers effecting non-parallel rather than parallel displacement of the members.

Radially inward movement of the reaction members 32 is effected by springs 35 acting between the stator body 24 and the linkages 33 and, most importantly and as will be explained in more detail in connection with FIGS. 3*a* to 3*f*, by the combustion gas jets acting against curved deflection surfaces 36—in effect spoiler surfaces—of the reaction members. Radially outward movement of the reaction members 32 is effected by the cams 23, for which purpose the reaction members are contacted by the cam elements of the cams during rotation of the rotor and, as the rotor continues to rotate, are displaced back into the housings 31. Each reaction member 32 can be provided at laterally opposite corner portions, forming cam followers 37 with, for example, suitable cam follower slide pins (not shown) to run on the cam elements.

The stator assembly is provided with suitable exhaust ports for the exhaust of combusted gas leaving the stator recesses 16, i.e. expansion chambers, by way of the openings to the reaction member housings 31, such exhaust ports being provided in, for example, the circumferential cover 25.

The engine 10 preferably includes seals to preclude undesired escape of combustion gas from the expansion chambers, such seals being typically provided at the sides of the insert blocks 15 and of the reaction members 32, and at the periphery of the rotor body 13, to cooperate with the radially outer annular cover plates 26. Further seals are provided at the radially outermost surfaces of the insert blocks 15 to co-operate with the inner circumference of the stator body 24, and at the radially innermost surfaces of the reaction members 32. Apart from sealing strips at the radially outermost surfaces of the insert blocks 15, such seals are not, for the sake of simplicity, shown in the drawings. The seals expediently consist of a sealing material with a highly smooth facing.

FIGS. 1 and 2 of the drawings show the preferred embodiment of the engine in highly simplified form so that essential constructional features can be represented without being obscured by the numerous ancillary details intrinsic to engine construction. In this connection it is to be noted that two of the reaction members 32 have been omitted in the broken-away section of the stator 12 in FIG. 2, their positions being denoted by the dotted-line representations of their respective housings 31.

Although the illustrated embodiment of the engine has four combustion chambers 17 and eight reaction members 32, the number of combustion chambers and the number of reaction members can be varied as desired consistent with smooth running of the engine within the basic design parameters.

The operation of the engine, whereby the rotor 11 is constrained to rotate relative to the stator 12, will now be described with reference to one combustion process as diagrammatically illustrated in FIGS. 3*a* to 3*f*. Each of FIGS. 3*a* to 3*f* shows a static part of the stator 12, with a single reaction member 32 and associated housing 31, linkage 33 and spring 35, and a continuously changing part of the rotor 11 with recesses 16, cams 23, insert blocks 15 and associated combustion chamber parts 18 and 19, ducts 20 and 21 and ignition probes 22. The rotor 11 rotates in the direction of the arrow.

FIG. 3*a* shows an initial phase in which an insert block 15 is disposed under the illustrated reaction member housing 31 and the reaction member 32 is fully retracted into the housing, the reaction member having been displaced into this position by the cam 23 and maintained in this position by the radially outermost surface of the insert block. Fuel constituents are charged into the space 18 by way of the ducts 20 and 21, where ignition takes place spontaneously or by way of the probe 22. At low rotor speeds, ignition occurs at discrete cyclic intervals, i.e. ignition is intermittent, but at higher rotor speeds ignition is virtually continuous in view of the short angular travel of each combustion chamber between successive reaction members.

Assuming that the rotor 11 is rotating, whether by way of on-going combustion processes in the other combustion and expansion chambers or by way of a starting device for effecting preliminary rotation, movement of the rotor in the arrow direction and into the position shown in FIG. 3*b* permits radially inward displacement of the reaction member 32. In the non-operating state of the engine, the spring 35 serves to urge the reaction member 32 into the recess 16 thereby to establish pre-conditions for starting, but when combustion occurs the reaction member 32 is rapidly drawn into the recess 16 by the action of the jet of combustion gas, illustrated by arrows in FIG. 3*b*, exiting the nozzle 19. The jet impinges against and is upwardly deflected by the deflection surface 36 of the reaction member 32 whereby, in analogous manner to aerodynamic spoiling devices, the force of the impinging jet stream is translated into radially inward displacement of the reaction member.

A further phase of this displacement is shown in FIG. 3*c*, wherein a small part of the gas exits the expansion chamber by way of the opening to the housing 31 before this opening is closed by the reaction member 32 in its fully extended position. The extended position of the reaction member is shown in FIG. 3*d*. The utilisation of the combustion gas jet in this way ensures a particularly rapid inward displacement of the reaction member without the need for cam or spring drives.

FIGS. 3*c* and 3*d* also show that, as a consequence of the radially inward displacement of the reaction member 32, the rotor 11 is rotated by the mutually opposite forces acting on the rotor 11 and stator 12, namely at the insert block 15 on the one hand and the reaction member 32 on the other hand, these forces being exerted by the combustion gas jet and associated gas expansion as is known in the field of internal combustion engines and gas turbines.

FIG. 3*e* shows a phase similar to that of FIG. 3*d*, with the reaction member 32 fully extended but with the rotor 11 rotated so far that the cam 23 at the downstream end of the recess 16 approaches the reaction member.

Figure 3F:
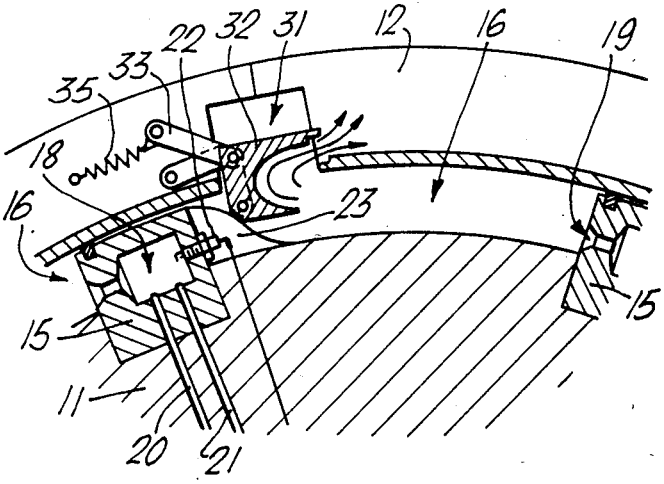

In FIG. 3*f* continuing rotation of the rotor has brought the cam 23 into contact with the reaction member 32 to effect radially outward displacement of the reaction member into its housing 31. During this phase, the combustion gas exits the expansion chamber by way of the opening to the housing 31, as indicated by the arrows in FIG. 3*f*, and then departs through the associated exhaust port.

Rotation of the rotor 11 and radially outward displacement of the reaction member 32 continues until the phase of FIG. 3*a* is again apparent, but with the succeeding insert block 15 disposed under the reaction member. The combustion phase concerning the illustrated reaction member 32 can thus repeat for the combustion chamber of the succeeding block 15, while the combustion chamber disappearing from view in FIG. 3*f* can initiate a combustion phase with the next one of the reaction members it encounters.

Although the invention has been described in the foregoing with reference to a specific embodiment of the engine, it will be apparent that alterations and modifications can be made without departing from the spirit of the invention. In this connection, it is within the purview of the invention to arrange the expansion and combustion chambers in the outer annular element and the reaction members in the inner circular element, either element serving as the rotor.

I claim:

1. An internal combustion engine comprising a circular inner element and a concentric annular outer element which are disposed so that the inner circumference of said outer element surrounds the outer circumference of said inner element and which are mounted for relative rotation about the axis of concentricity thereof, wherein one of said elements is provided at said circumference thereof with means defining a plurality of recesses equidistantly spaced around said circumference to each serve as an expansion chamber for combustion gas and further defining a corresponding plurality of combustion chambers each disposed at one end of an associated one of the recesses and each having a nozzle portion opening circumferentially into said recess for causing combustion gas from combustion of a combustible substance in the chamber to form a jet entering the associated one of said recesses directed generally towards the other end of the recess, and wherein the other one of said elements is provided with a plurality of equidistantly spaced reciprocating reaction members each movable in a first direction of movement to project radially from said circumference of said other element and into each of said recesses in turn thereby to be so acted on by said combustion gas in each recess that forces acting in opposite sense on said elements are created to effect relative rotation thereof and is further provided with a respective exhaust port within said circumference of said other element for closure by each said reaction member only when movement of the reaction member in said first direction of movement thereof is substantially complete, each said reaction member having deflector surface means for deflecting the gas jet in each said recess out through the respectively associated exhaust port and translating a component of the energy of the deflected jet into a force displaying the reaction member in said first direction of movement thereof until said closure of said exhaust port, and said one element being provided at said other end of each said recess with respective cam means to displace each said reaction member in turn in a second direction of movement thereof opposite to said first direction of movement and thereby out of that recess.

2. An engine according to claim 1, wherein said deflector surface means of each said reaction member defines a concavity in the member.

3. An engine according to claim 1, wherein said other one of said inner and outer elements comprises respective resilient means biassing each said reaction member in said first direction of movement thereof.

4. An engine according to claim 1, wherein said other one of said inner and outer elements is provided with respective guide linkage means mounting each said reaction member.

5. An engine according to claim 1, wherein said other one of said inner and outer elements is provided with respective pivot lever means mounting each said reaction member.

6. An engine according to claim 1, wherein each said reaction member is provided with abutment means engageable with said other one of said inner and outer elements to limit movement of the member in said first direction of movement.

7. An engine according to claim 1, comprising annular cover portions covering said recesses at the axial end faces of said inner and outer elements.

8. An engine according to claim 1, wherein said other one of said inner and outer elements comprises means defining a plurality of housings each for receiving a respective one of said reaction members on displacement thereof in said second direction of movement.

9. An engine according to claim 1, wherein each said combustion chamber has the form of a space for reception of said combustible substance and a nozzle connecting said space to the associated one of said recesses.

10. An engine according to claim 1, wherein said one element of said inner and outer elements comprises a body portion and a plurality of equidistantly spaced insert portions mounted in said body portion and projecting therefrom, said recesses being provided between said insert portions and said combustion chambers being provided within said insert portions.

11. An engine according to claim 1, wherein each said cam means defines two spaced cam tracks each adjacent a respective one of the axial ends of said inner and outer elements and wherein each said reaction member comprises two spaced cam follower portions each slidably engageable with a respective one of the cam tracks of the associated cam means.

12. An engine according to claim 1, wherein said annular outer element is comprised of a plurality of circularly arcuate segments surrounding said circular inner element.

13. An engine according to claim 1, wherein said recesses and combustion chambers are in said inner element and said reaction members are in said outer element.

14. An engine as claimed in claim 13, comprising an axle provided with means defining axial feed bores therein, said inner element being mounted on said axle and being provided with duct means for conducting constituents of said combustible substance from said axial feed bores to each said combustion chamber.

15. An engine according to claim 1, wherein said inner element is mounted to be rotatable thereby to function as a rotor of the engine and the outer element is mounted to be stationary thereby to function as a stator of the engine.

* * * * *